US009253861B2

(12) United States Patent
Wolter et al.

(10) Patent No.: US 9,253,861 B2
(45) Date of Patent: Feb. 2, 2016

(54) CIRCUIT ARRANGEMENT AND METHOD FOR OPERATING AT LEAST ONE DISCHARGE LAMP

(71) Applicant: OSRAM GmbH, Munich (DE)

(72) Inventors: Kai Wolter, Berlin (DE); Norbert Magg, Berlin (DE)

(73) Assignee: OSRAM GmbH, Munich (DE)

( * ) Notice: Subject to any disclaimer, the term of this patent is extended or adjusted under 35 U.S.C. 154(b) by 0 days.

(21) Appl. No.: 14/383,143

(22) PCT Filed: Feb. 28, 2013

(86) PCT No.: PCT/EP2013/054040

§ 371 (c)(1),
(2) Date: Sep. 5, 2014

(87) PCT Pub. No.: WO2013/131802

PCT Pub. Date: Sep. 12, 2013

(65) Prior Publication Data

US 2015/0077018 A1 Mar. 19, 2015

(30) Foreign Application Priority Data

Mar. 6, 2012 (DE) ..... 10 2012 203 516

(51) Int. Cl.
*H05B 41/36* (2006.01)
*H05B 41/28* (2006.01)
(Continued)

(52) U.S. Cl.
CPC ..... *H05B 41/28* (2013.01); *H05B 41/2887* (2013.01); *H05B 41/2928* (2013.01); *H05B 41/36* (2013.01)

(58) Field of Classification Search
CPC ..... H05B 41/2928; H05B 41/2883; H05B 41/2888; H05B 41/2825; H05B 41/388; H05B 41/2824; H05B 41/2881; H05B 41/2887; H05B 41/2926; Y02B 20/208; Y02B 20/186; Y10S 315/07
USPC ..... 315/224, 291, 307, 209 R, 308, DIG. 7, 315/128, 216
See application file for complete search history.

(56) References Cited

U.S. PATENT DOCUMENTS 7,355,355 B2 * 4/2008 Okamoto ..... H05B 41/2928 315/209 R
7,511,431 B2 * 3/2009 Lesch ..... H01J 61/34 315/56

(Continued)

FOREIGN PATENT DOCUMENTS

DE 102007057772 A1 6/2008
EP 1624733 A2 2/2006

(Continued)

OTHER PUBLICATIONS

German Office Action for DE 10 2012 203 516.8 dated Oct. 10, 2012.

(Continued)

*Primary Examiner* — Minh D A
*Assistant Examiner* — Borna Alaeddini
(74) *Attorney, Agent, or Firm* — Viering, Jentschura & Partner

(57) ABSTRACT

Various embodiments may relate to a circuit arrangement for operating at least one discharge lamp having a commutation device and a control device which is coupled to the commutation device. A first measuring device is used to determine in each case first measurement values, which represent a measure of the magnitude of electrode peaks of the discharge lamp, within a test operating phase in which the first electrode and the second electrode are supplied with energy in an asymmetrical manner. A second measuring device is used to determine a second measurement value which is correlated with the current through the discharge lamp at least during the test operating phase. The control device is designed to actuate the commutation device at least as a function of the determined first measurement values and second measurement values. Various embodiments further relate to a corresponding method for operating at least one discharge lamp.

15 Claims, 2 Drawing Sheets

(51) Int. Cl.
*H05B 41/288* (2006.01)
*H05B 41/292* (2006.01)

(56) References Cited

U.S. PATENT DOCUMENTS

| | | | | |
|---|---|---|---|---|
| 7,946,715 | B2 * | 5/2011 | Yamauchi | H05B 41/2928 315/246 |
| 7,994,734 | B2 | 8/2011 | Breuer et al. | |
| 8,183,796 | B2 * | 5/2012 | Terashima | H05B 1/2928 315/299 |
| 8,602,566 | B2 | 12/2013 | Baier et al. | |
| 2006/0012309 | A1 | 1/2006 | Monch et al. | |
| 2010/0052496 | A1 | 3/2010 | Matsumoto et al. | |
| 2010/0157257 | A1 | 6/2010 | Nishizawa et al. | |
| 2010/0201281 | A1 | 8/2010 | Terashima et al. | |
| 2011/0128508 | A1 | 6/2011 | Yamada et al. | |

FOREIGN PATENT DOCUMENTS

| | | | |
|---|---|---|---|
| EP | 1809081 | A2 | 7/2007 |
| WO | 2008071232 | A1 | 6/2008 |
| WO | 2009007914 | A1 | 1/2009 |
| WO | 2010086222 | A1 | 8/2010 |
| WO | 2011147464 | A1 | 12/2011 |

OTHER PUBLICATIONS

International Search Report for PCT/EP2013/054040 dated May 17, 2013.
English abstract for DE 10 2007 057 772 A1 dated Jun. 19, 2008.

* cited by examiner

CIRCUIT ARRANGEMENT AND METHOD FOR OPERATING AT LEAST ONE DISCHARGE LAMP

RELATED APPLICATIONS

The present application is a national stage entry according to 35 U.S.C. §371 of PCT application No.: PCT/EP2013/054040 filed on Feb. 28, 2013, which claims priority from German application No.: 10 2012 203 516.8 filed on Mar. 6, 2012, and is incorporated herein by reference in its entirety.

TECHNICAL FIELD

Various embodiments relate to a circuit arrangement for operating at least one discharge lamp, including a commutation device including an input for coupling to a DC voltage source and an output for coupling to the at least one discharge lamp, a control device, which is coupled to the commutation device for providing at least one control signal to the commutation device, a first measuring device, which is coupled to the control device, wherein the first measuring device is configured to determine a first measured value, which represents a measure of the size of electrode tips of the at least one discharge lamp, wherein the control device is configured to actuate the commutation device within a test operation phase in such a way that energy is applied to the first electrode and the second electrode asymmetrically, wherein the control device is furthermore configured to determine the first measured value firstly during the asymmetric application of energy to the first electrode and secondly during the asymmetric application of energy to the second electrode, wherein, on the respective determination of the first measured value, the respective electrode acts as anode, and wherein the control device is configured to actuate the commutation device depending on at least the determined first measured values. Moreover, it relates to a corresponding method for operating at least one discharge lamp.

BACKGROUND

Such a circuit arrangement and a related method are known from DE 10 2007 057 772 A1.

A general problem during operation of discharge lamps is the changes in the electrode geometry over the course of their life. This applies in particular to the frontmost region of the electrode head, where, as a result of the arc attachment, temperatures close to the melting point of the electrode occur. In the case of lamps operated on alternating current, in particular in the case of lamps which are used in video projection, the growth of tips on the electrode head can be achieved by suitable operational parameters. Such tips have a positive effect on the properties of the lamp, for example in respect of luminance and electrode burnback. The response over the life and the effective luminous flux of such a lamp are therefore critically dependent on the stability of the electrodes or the electrode tips that have grown on over the course of the life. Of particular relevance in this case are the length and the diameter of the electrode tips.

Depending on specific conditions, generally the following response can be observed: in the case of excessive burnback, the electrode tips become small and narrow. Excessive fusing, on the other hand, results in the electrode tips becoming very wide or long. Moreover, this may result in an asymmetric development of the electrode tips.

In the related art, there is a large number of documents which handle the topic of electrode stability, in particular in respect of excessive electrode burnback, on the one hand, or in respect of excessively pronounced fusing of the electrodes, on the other hand. In this context, reference is made to WO 2009/007914 A1, for example.

The starting point with the method known from the related art is generally an apparatus with the aid of which a value is determined which represents a measure of the present length of the electrode spacing. Generally, the measurement of the lamp voltage with the aid of a suitable circuit which is integrated in the electronic ballast for operation of the lamp is intended thereby. Depending on the measured value of the lamp voltage, in the case of one or more voltage threshold values changes to the operational parameters of the discharge lamp are performed, for example matching of the lamp frequency or the profile of the lamp current.

One disadvantage with these known methods consists in that an asymmetric development of the electrode tips is not detected. Moreover, the absolute value of the voltage is only correlated conditionally with the state of the electrode tips which is actually of interest, i.e. in the case of two lamps with one and the same voltage value, the state of the electrodes can differ markedly, for example determined by manufacturing tolerances during lamp construction, but also in terms of the application used by the customer.

This is improved by the teaching of DE 10 2007 057 772 A1, already mentioned, which discloses the circuit arrangement of the generic type or the method of the generic type.

Said document is concerned with the avoidance of flicker phenomena and of the reduction of the lamp voltage in the case of excessive formation of electrode tips. In order to prevent these effects, the document proposes suppressing commutation operations during operation of the discharge lamps with a square-wave current, as a result of which fusing of the electrode tips arises. In order to detect the tip geometry, it is proposed in particular to suppress the switching during a first test time in a first polarity and in the process to determine the change in the lamp voltage, and then to suppress the switching during a second test time of the same duration as the first test time in a second polarity, which is different than the first polarity, and in the process again to determine the change in the lamp voltage. Finally, the switching is suppressed during a fusing time, which is longer than the test times, wherein, during the fusing time, the polarity which effected the greater change in the lamp voltage during the preceding test times is selected.

US 2006/0012309 A1 discloses a method in which attempts are made, by suitable operational parameters, to compensate for asymmetries which are expected from the beginning during the life. US 2010/0052496 A1 discloses a method in which electrodes dimensioned differently from the beginning are used in order to compensate an expected asymmetry.

In relation to further related art, reference is also made to WO 2010/086222 A1.

The disadvantage of the procedure known from the mentioned DE 10 2007 057 772 A1 consists in that this procedure sometimes results in good results, but often also in unusable results.

SUMMARY

The object of the present disclosure therefore consists in developing the circuit arrangement known from the related art or the method known from the related art in such a way that the life of the discharge lamp is increased and, moreover, the light output by the discharge lamp remains of as high a quality as possible over the life.

The present disclosure is based on the finding that the results which cannot be achieved in the case of implementations on the basis of the teaching of DE 10 2007 057 772 A1 are based on the fact that the temperature dependence of the measured values both during the test phase and during the manipulation of the tip geometry is not taken into consideration. In particular, the fact that the running voltage U of a discharge lamp changes markedly over the course of the life and therefore also the lamp current I changes in a typically power-regulated application is not taken into consideration.

FIG. 1 shows, in this context, a typical change in the lamp current I and the lamp voltage U over the life of a discharge lamp with a constant power P using the example of a 230 W discharge lamp. Since the temperature of the electrodes or the electrode tips of the discharge lamp is correlated with the lamp current I, it follows from the illustration in FIG. 1 that the significance of a test phase decreases overproportionately with decreasing lamp current I and therefore with increasing age of the discharge lamp.

In principle it is true that an electrode tip with a given geometry responds to test phase operation with a lower relative voltage change at low lamp currents than a tip of the same geometry at high lamp currents. Therefore, owing to the burnback occurring over the life, it is absolutely necessary to match the test phase operation and the response thereto, i.e. the manipulation of the tip geometry, depending on the lamp current. Without taking into consideration this current dependence, there is the risk of erroneous interpretation of the first measured values determined during the test phase operation, in particular in the later phases of the life of the discharge lamp.

The lower the lamp current, the more pronounced the asymmetric application of energy to the electrodes in a test operation phase needs to be in order to bring about comparable responses. This relates in the same way to the manipulation of the tip geometry following the test operation phase. This means that the lamp current needs to be taken into consideration in order to effect a comparatively large degree of overfusing of the electrode tips and a voltage variation associated therewith. This can take place by excessively increasing the current or extending the time of action.

If this dependence is not taken into consideration, as in the related art in accordance with the mentioned DE 10 2007 057 772 A1, but the procedure is performed with a fixedly set test phase, independent of the lamp current, i.e. with a fixed current value or a fixed length of time of the asymmetric application, the measured values obtained in the process are necessarily interpreted incorrectly as soon as the lamp current has reduced as the result of electrode burnback. For example, with a given tip geometry, relatively low first measured values will be obtained at relatively low currents, which would be interpreted as a tip which has become wider although this is in practice generally not the case. In addition, there is the risk that, in the case of asymmetric application to the electrodes which is selected to be too great, in order to effect, for example, a presettable voltage variation, irreversible damage to the electrodes may occur in the case of high lamp currents.

In various embodiments, it is therefore provided that the circuit arrangement furthermore includes a second measuring device, which is designed to determine at least one second measured value, which is correlated with the current through the at least one discharge lamp at least during the test operation phase, wherein the second measuring device is coupled to the control device, wherein the control device is configured to actuate the commutation device at least depending on the determined first measured values and second measured values. In this case, the current is preferably measured prior to the test phases, but can also be measured during the test phases. Only by virtue of the development according to the present disclosure can reliable conclusions be drawn in respect of the measured values obtained during the test operation phase and therefore reliable conclusions drawn in respect of the state of the two electrodes. As a result, suitable measures for the manipulation of the tip geometries can be performed. This results in optimization of the luminance of the discharge lamp over the life and contributes to marked extension of the lamp life.

Preferably, for averaging purposes, the RMS current is measured over several commutation operations.

In various embodiments, the control device is configured to generate the asymmetric energy input by virtue of the fact that it actuates the commutation device so as to effect at least one of the following measures: shifting of commutation operations; omission of commutation operations; different pulse length for the first electrode and the second electrode; and different pulse height for the first electrode and the second electrode.

These measures can be implemented in a particularly simple manner, in particular with little complexity, which substantially consists only in corresponding programming of the control device.

Preferably, the first measuring device is configured to measure the lamp voltage. For this, known measuring devices are available, with the result that the implementation can be realized without any problems.

Preferably, a characteristic is stored in the control device, in particular as a formulaic relationship or as a lookup table, in which the dependence of the actuation signal to be coupled to the commutation device on the determined first measured values and second measured values is reproduced. This makes it possible, in a particularly simple and quick manner, to determine the drive signal to be coupled to the commutation device depending on the first and second measured values determined.

The control device may be configured to regulate the first measured value. In this case, it can in particular be designed to change the asymmetric energy input successively until a presettable change in the first measured value can be established. This can take place, for example, in such a way that a predeterminable voltage variation is intended to be achieved. Thus, the characteristic to be stored in the control device is simplified since the respective first measured value is constant, for example corresponds to a constant voltage variation.

Alternatively, it can be provided that the control device is configured to actuate the commutation device so as to effect a presettable asymmetric energy input. This generally results in different first measured values in the case of different discharge lamps, but does not have any negative effects during detection of the first measured value.

The second measured value in particular represents a voltage. This can be determined particularly easily and in a manner free of losses and therefore enables a high degree of efficiency of a circuit arrangement according to the present disclosure.

The first measured value may represent a change in a voltage value between normal operation of the discharge lamp and test operation with an asymmetric energy input.

To this extent it is not necessary to detect the absolute value of the voltage; instead, detection of the relative voltage change is sufficient. This can take place with increased accuracy owing to the independence of this voltage change on the absolute value of the voltage, in particular in the case of digital evaluation of the voltage variation, and therefore enables particularly good accuracy.

In this context, the control device is configured to actuate the commutation device as follows:

a) if the difference between the first measured value at which the first electrode operates as anode and the first measured value at which the second electrode operates as anode is below a first presettable threshold value, which is dependent on the second measured value during the determination of the two first measured values:
   a1) if the two measured first measured values are below a second presettable threshold value, which is dependent on the second measured value during the determination of the two first measured values:
      actuating the commutation device in such a way that the first electrode and the second electrode are prevented from fusing;
   a2) if the two measured first measured values are above a third presettable threshold value, which is dependent on the second measured value during the determination of the two first measured values:
      actuating the commutation device in such a way that growth of the electrode tips of the first electrode and the second electrode is effected;

b) if the difference between the first measured value at which the first electrode operates as anode and the first measured value at which the second electrode operates as anode is above a fourth presettable threshold value, which is dependent on the second measured value during the determination of the two first measured values:
   actuating the commutation device in such a way that an asymmetric change in the voltage tips is effected.

By virtue of this case distinction, different states of the electrode tips are taken into precise account, with the result that, depending on different states of the electrode tips, always the suitable measure for optimizing the luminance or for increasing the life is implemented.

The term "during" in the context where a presettable threshold value is dependent on the second measured value during the determination of the two first measured values also includes, within the scope of the present disclosure, a temporally close determination of the second measured value, i.e. in particular a determination of the second measured value shortly or directly prior to the determination of the first measured values.

It should be assumed that, in step a1), the tips are very wide. There is therefore the risk of excessive fusing. Preferably, therefore, in step a1), the actuation of the commutation device effects at least one of the following measures: increasing the lamp frequency; decreasing the energy in the switching pulses; shifting the switching positions to lower switching pulses, wherein a switching pulse represents an excessive current increase in a half-cycle with a presettable amplitude, after which switching takes place.

In step a2), on the other hand, the tips are very small. There is the risk of accelerated burnback. It can therefore be provided that in step a2), the actuation of the commutation device effects at least one of the following measures: decreasing the lamp frequency; increasing the energy in the switching pulses; shifting the switching positions to higher switching pulses.

In step b), the geometry of the electrode tips differs from one another. Therefore, this development is counteracted with an asymmetrically configured measure. Preferably, therefore, in step b), the actuation of the commutation device takes place in such a way that at least one of the following measures is effected: reducing the energy input of that electrode whose first measured value was the greater of the two first measured values; actuating the commutation device in such a way that a growth of the electrode tip of that electrode whose first measured value was the greater of the two first measured values is effected.

Various embodiments set forth in relation to the circuit arrangement according to the present disclosure and the advantages thereof apply correspondingly, insofar as they are applicable, to the method according to the present disclosure.

BRIEF DESCRIPTION OF THE DRAWING(S)

In the drawings, like reference characters generally refer to the same parts throughout the different views. The drawings are not necessarily to scale, emphasis instead generally being placed upon illustrating the principles of the disclosed embodiments. In the following description, various embodiments described with reference to the following drawings, in which.

Figure 3:
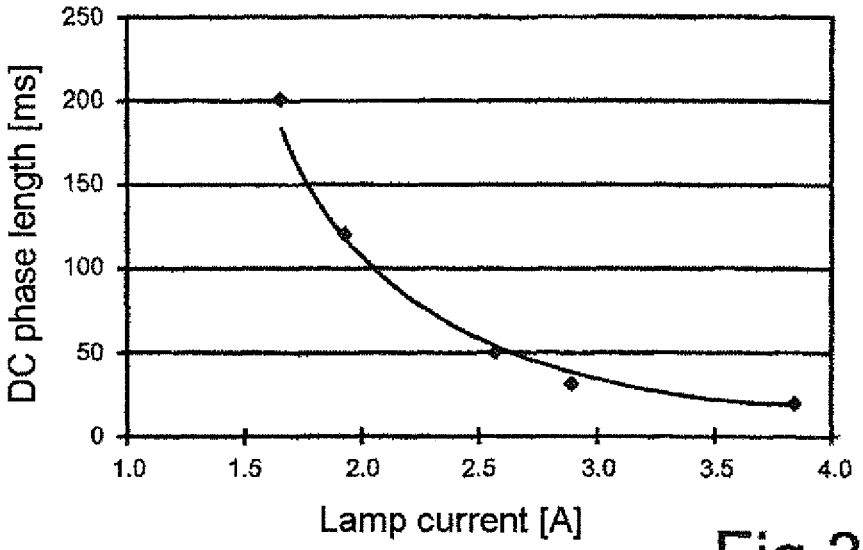
Figure 4:
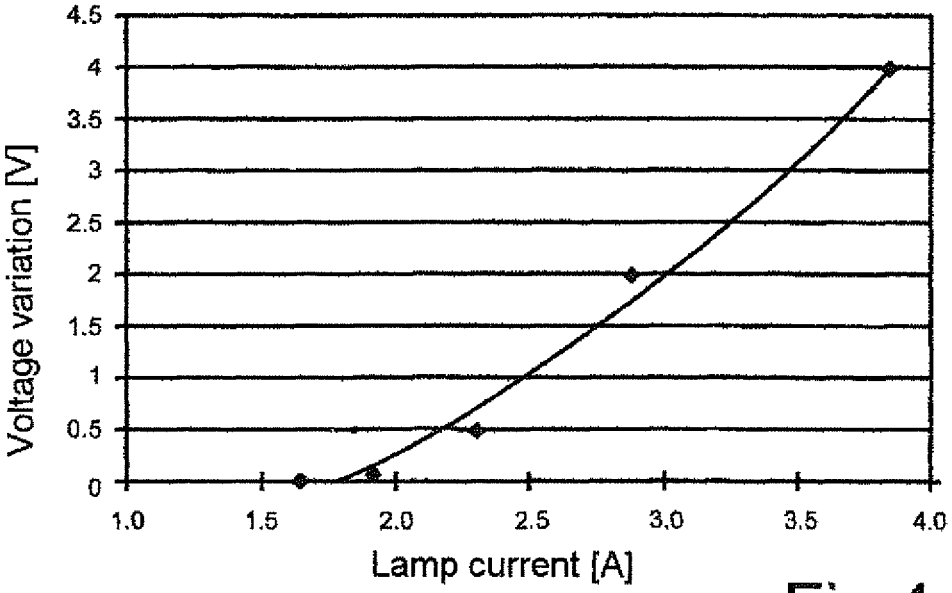

FIG. 3 shows a schematic illustration of the dependence of the temporal length of an asymmetric energy input in the form of a DC phase as a function of the lamp current for effecting a constant voltage variation in the case of a 230 W discharge lamp with a given tip geometry of the electrodes; and FIG. 4 shows the dependence of the voltage variation of a 230 W discharge lamp with a given tip geometry of the electrodes as a response to a preset asymmetric energy input as a function of the lamp current.

DETAILED DESCRIPTION

The following detailed description refers to the accompanying drawing that show, by way of illustration, specific details and embodiments in which the disclosure may be practiced.

Figure 1:
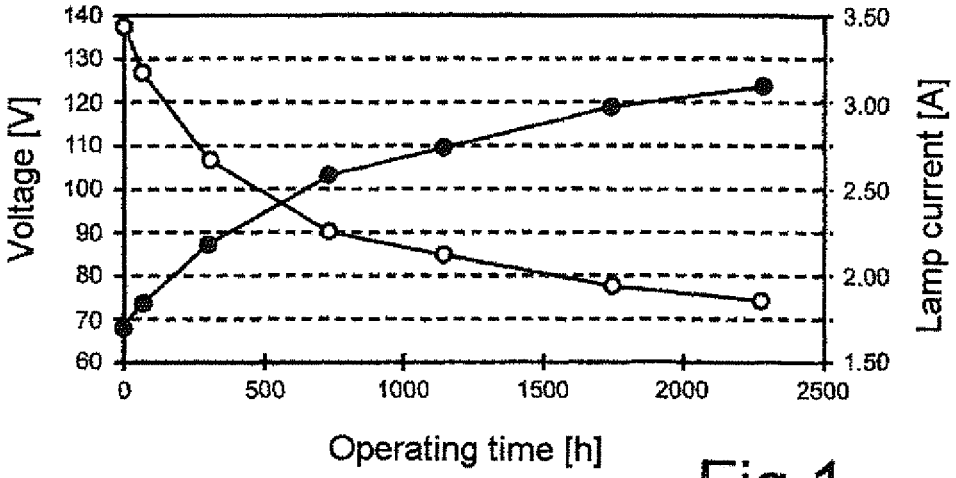
FIG. 1 shows the change in the lamp current I and the lamp voltage U during the life of a 230 W discharge lamp on power-regulated operation, i.e. at a constant power P.
Figure 2:
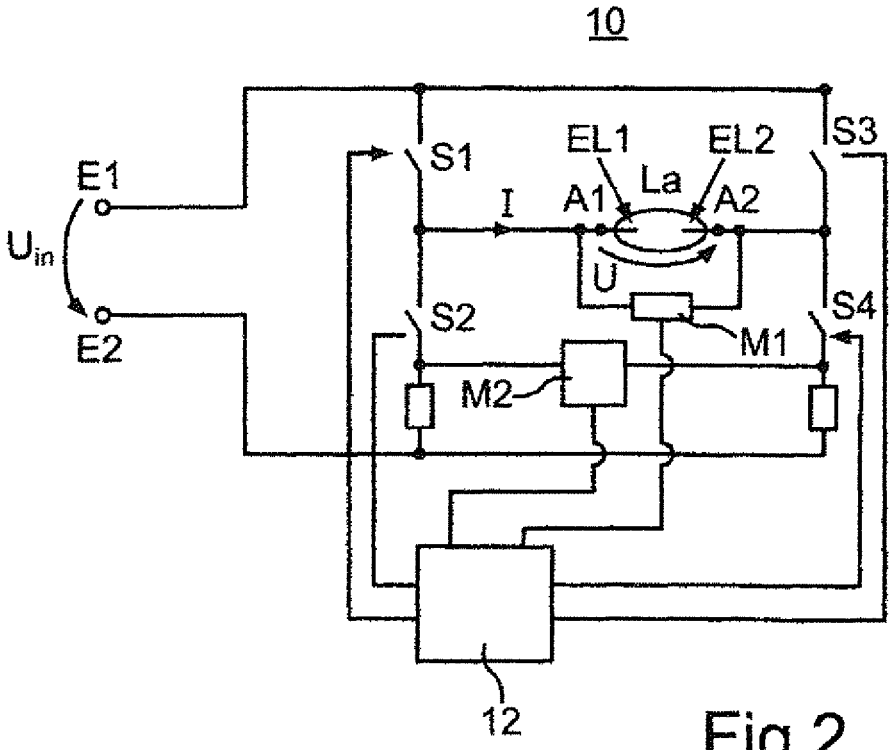
FIG. 2 shows a schematic illustration of an exemplary embodiment of a circuit arrangement according to the present disclosure.

FIG. 2 shows a schematic illustration of an exemplary embodiment of a circuit arrangement 10 according to the present disclosure for operating at least one discharge lamp La. The circuit arrangement 10 includes a commutation device, which in this case includes the switches S1 to S4 in a full-bridge arrangement. The respective series circuit including the switches S1 and S2, on the one hand, and the switches S3 and S4, on the other hand, is coupled to an input, which includes a first input connection E1 and a second input connection E2. The discharge lamp La is coupled to the output of the circuit arrangement, wherein the output includes a first output connection A1 and a second output connection A2.

A control device 12 is coupled to the commutation device S1 to S4 so as to provide at least one control signal to the commutation device, in particular to the control electrodes of the switches S1 to S4. A first measuring device M1, which is coupled to the control device 12, is configured to determine a first measured value MW1, which represents a measure of the size of electrode tips of the discharge lamp La.

The control device 12 is configured to drive the commutation device S1 to S4 within a test operation phase in such a way that energy is applied to the first electrode E11 and to the second electrode E12 asymmetrically. The control device 12 is in particular configured to determine the first measured value MW1 firstly during a phase in which more energy is applied to the first electrode E11 than to the second electrode E12, and secondly during a phase in which more energy is applied to the second electrode E12 than the first electrode E11. As a result, two first measured values MW11 and MW12 are obtained, wherein, in the case of the respective determination of the first measured value MW1, the respective electrode E11, E12 operates as anode.

The circuit arrangement 10 furthermore includes a second measuring device M2, which is designed to return at least one second measured value MW2, which is correlated with the current I through the discharge lamp La at least during the test operation phase. The second measuring device M2 is likewise coupled to the control device 12, wherein the control device 12 is configured to drive the commutation device S1 to S4 depending on the determined first measured values MW11, MW12 and second measured values MW21, MW22.

The circuit arrangement illustrated in FIG. 2 makes it possible to find out the tip state by virtue of the fact that each electrode tip is subjected to a suitable test operation phase individually and the reaction of said electrode tip to this is sensed. In principle, any form of short-term asymmetric energy input into the electrodes, for example a suitably long DC phase or asymmetric lamp current profile, for example as a result of modification of the pulse length, the pulse height or as a result of an increase in current on one side, is suitable as test operation phase. The response to this test operation phase consists in a change or the absence of a change in the electrode tip geometry, which can be detected by a relative change in voltage, i.e. a voltage variation, for example. Alternatively, a reverse procedure can also be expedient, i.e. instead of presetting a test operation phase with a predefined "intensity" and interpreting the level of the response signal, it is also possible to detect how severe a test operation phase needs to be in order to achieve a preset response signal.

A detection of the tip state may be implemented by impressing a DC phase of a fixed length, for example 100 ms, or increasing, on one side, the pulse current by, for example, 30% and then detecting the relative voltage change. If this relative voltage change is great, for example greater than 3 V, this tends to be a small, thin tip. If, on the other hand, it is small, for example less than 1 V, this tends to be a large, thick tip. In this case, the test operation phase is implemented separately in both current directions of AC operation, wherein in each case that electrode which is in the anode phase at that time is sampled. The reason for this consists in that the cathode responds only weakly to such a test operation phase.

The result of this sampling can be divided into two cases which are different in principle:

Case a)

Both tips demonstrate a voltage change of similar magnitude.

Depending on the level of this voltage change, a suitable measure can be taken which takes effect in the same way on both electrodes, for example matching of the lamp frequency or the lamp current profile.

Case a1)

If a fusing voltage change results, this means that the tips are very wide and there is the risk of excessive coalescence. A countermeasure accordingly consists in increasing the lamp frequency or decreasing the energy in the switching pulses, for example by means of driving with smaller pulses, shorter pulses or changing the switching scheme.

Case a2)

Large change in voltage, i.e. the tips are very small. There is the risk of accelerated burnback. As a countermeasure, the lamp frequency is decreased or the energy in the switching pulses is increased, for example higher pulses, longer pulses or a change in the switching scheme or activation of a lamp maintenance mode, such as, for example, power modulation next time the lamp is switched off or an indication on the projector "switch on maintenance mode". In this connection, reference is made to WO 2011/147464 A1.

Case b)

If the two tips have a markedly different voltage change, it is necessary to attempt to counteract this development with an asymmetric measure, for example with a general DC component of suitable polarity with more frequent or longer DC phases of suitable polarity, as is known, for example, from WO 2010/086222 A1 or other methods which result in an asymmetric energy input into the electrode, for example such that that electrode which has demonstrated a more pronounced response to the test phase from now on experiences a reduced input; see in this regard US 2006/0012309 A1, for example. Since the reason for the asymmetric development is ultimately unknown, it may possibly be expedient to test a plurality of manipulation methods and to determine the success with one of the detection methods according to the present disclosure.

FIG. 3 shows a schematic illustration of the dependence of the change performed by asymmetric input of energy in the form of an extension of the DC pulse of a square-wave signal used for driving the commutation device in order to generate a presettable constant voltage variation with a given tip geometry, as a function of the lamp current using the example of a 230 W discharge lamp. Accordingly, a DC phase which has been achieved by targeted "omission" of commutations of a square-wave signal, has been used as test operation phase. In order to determine this connection, lamps with comparable electrode tip geometries but markedly different electrode spacing have been used. Since the electrode spacing is correlated with the lamp voltage U, in this case a dependence on the lamp current I results in the case of a power-regulated operating mode. In the next step, the length of the DC test operation phase was then matched in each case, originating from small values, until the same voltage variation of 2 V was measured as a response to the test operation phase for all lamps, i.e. for all associated values of the lamp current I.

This relationship can be stored in the form of a characteristic in a table stored in the control device 12. In practice, it may be expedient in the case of power-regulated operation to convert the current dependence into a voltage dependence since this can be detected and processed more easily in terms of measurement technology by the respective measuring device.

Alternatively, in the case of a fixedly set test phase operation, i.e. a fixed current value or a fixed temporal length, the response signal, for example the voltage variation, can also be specified as a function of the lamp current I.

FIG. 4 shows, in this connection, the voltage variation as a response to a fixed test phase operation as a function of the lamp current I for a 230 W discharge lamp. This dependence can also be stored in the control device 12 in the form of a characteristic or table. However, with this variant, care needs to be taken very precisely to ensure that, firstly, the test phase operation does not result in excessive loading of the electrodes in order to prevent damage to the electrode tips in the case of high lamp currents. Secondly, it is necessary to ensure that a sufficiently large response signal is still obtained in the case of low lamp currents, which response signal can also be detected and interpreted easily. This boundary is achieved at a voltage variation of approximately 0.25 V.

In the case of a typical exemplary embodiment, the lamp power is 280 W, the lamp voltage prior to both DC test operation phases is in each case 65.3 V. The DC test operation phases are run with in each case a length of the DC pulse of 100 ms. These 100 ms start, for example, after the first omission of a commutation.

In the exemplary embodiment, a voltage rise from 65.3 to 65.8 V, i.e. a voltage variation of 0.5 V, was demonstrated as a response of the left-hand electrode tip to the 100 ms DC test operation phase. The response of the right-hand tip to the 100 ms DC test operation phase in this case demonstrated a voltage rise from 65.3 to 69.1 V, i.e. a voltage variation of 3.8 V. In general, such a difference in the voltage variation is a clear indication of an asymmetric development of the electrode tips, with the result that measures corresponding to the above-mentioned case b) can be initiated.

While the disclosed embodiments have been particularly shown and described with reference to specific embodiments, it should be understood by those skilled in the art that various changes in form and detail may be made therein without departing from the spirit and scope of the disclosed embodiments as defined by the appended claims. The scope of the disclosed embodiments is thus indicated by the appended claims and all changes which come within the meaning and range of equivalency of the claims are therefore intended to be embraced.

The invention claimed is:

1. A circuit arrangement for operating at least one discharge lamp, comprising;

a commutation device comprising an input for coupling to a DC voltage source and an output for coupling to the at least one discharge lamp;

a control device, which is coupled to the commutation device for providing at least one control signal to the commutation device; and a first measuring device, which is coupled to the control device, wherein the first measuring device is configured to determine a first measured value, which represents a measure of the size of electrode tips of the at least one discharge lamp;

wherein the control device is configured to actuate the commutation device within a test operation phase in such a way that energy is applied to a first electrode and a second electrode asymmetrically, wherein the control device is furthermore configured to determine the first measured value firstly during the asymmetric application of energy to the first electrode and secondly during the asymmetric application of energy to the second electrode, wherein, on the respective determination of the first measured value, the respective electrode acts as anode; and wherein the control device is configured to actuate the commutation device depending on at least the determined first measured values;

wherein the circuit arrangement further comprises a second measuring device, which is designed to determine at least one second measured value, which is correlated with the current through the at least one discharge lamp at least during the test operation phase;

wherein the second measuring device is coupled to the control device, wherein the control device is configured to actuate the commutation device at least depending on the determined first measured values and second measured values.

2. The circuit arrangement as claimed in claim 1, wherein the control device is configured to generate the asymmetric energy input by virtue of the fact that it actuates the commutation device so as to effect at least one of the following measures:

shifting of commutation operations;

omission of commutation operations;

different pulse length for the first electrode and the second electrode;

different pulse height for the first electrode and the second electrode.

3. The circuit arrangement as claimed in claim 1, wherein the first measuring device is configured to measure the lamp voltage.

4. The circuit arrangement as claimed in one of the claim 1, wherein a characteristic is stored in the control device, in which the dependence of the actuation signal to be coupled to the commutation device on the determined first measured values and second measured values is reproduced.

5. The circuit arrangement as claimed in claim 4, wherein the characteristic is stored in the control device as a formulaic relationship or as a lookup table.

6. The circuit arrangement as claimed in claim 1, wherein the control device is configured to regulate the first measured value.

7. The circuit arrangement as claimed in claim 6, wherein the control device is configured to change the asymmetric energy input successively until a presettable change in the first measured value can be established.

8. The circuit arrangement as claimed in claim 1, wherein the control device is configured to actuate the commutation device so as to effect a presettable asymmetric energy input.

9. The circuit arrangement as claimed in claim 1, wherein the second measured value represents a voltage.

10. The circuit arrangement as claimed in claim 1, wherein the first measured value represents a change in a voltage value between normal operation of the discharge lamp and test operation with an asymmetric energy input.

11. The circuit arrangement as claimed in claim 10, wherein the control device is configured to actuate the commutation device as follows:

a) if the difference between the first measured value at which the first electrode operates as anode and the first measured value at which the second electrode operates as anode is below a first presettable threshold value, which is dependent on the second measured value during the determination of the two first measured values:

a1) if the two measured first measured values are below a second presettable threshold value, which is dependent on the second measured value during the determination of the two first measured values:

actuating the commutation device in such a way that the first electrode and the second electrode are prevented from fusing;

a2) if the two measured first measured values are above a third presettable threshold value, which is dependent on the second measured value during the determination of the two first measured values:

actuating the commutation device in such a way that growth of the electrode tips of the first electrode and the second electrode is effected;

b) if the difference between the first measured value at which the first electrode operates as anode and the first measured value at which the second electrode operates as anode is above a fourth presettable threshold value, which is dependent on the second measured value during the determination of the two first measured values:

actuating the commutation device in such a way that an asymmetric change in the voltage tips is effected.

12. The circuit arrangement as claimed in claim 11, in a1), the actuation of the commutation device effects at least one of the following measures:

increasing the lamp frequency;

decreasing the energy in the switching pulses;

shifting the switching positions to lower switching pulses.

13. The circuit arrangement as claimed in claim 11, wherein, in a2), the actuation of the commutation device effects at least one of the following measures:

decreasing the lamp frequency;

increasing the energy in the switching pulses;

shifting the switching positions to higher switching pulses.

14. The circuit arrangement as claimed in claim 11, wherein, in b), the actuation of the commutation device effects at least one of the following measures:

reducing the energy input of that electrode whose first measured value was the greater of the two first measured values;

actuating the commutation device in such a way that a growth of the electrode tip of that electrode whose first measured value was the greater of the two first measured values is effected.

15. A method for operating at least one discharge lamp comprising a circuit arrangement, which comprises a commutation device comprising an input for coupling to a DC voltage source and an output for coupling to the at least one discharge lamp, and a control device, which is coupled to the commutation device for providing at least one control signal to the commutation device; a first measuring device, which is coupled to the control device, wherein the first measuring device is configured to determine a first measured value, which represents a measure of the size of the electrode tips of the at least one discharge lamp, wherein the control device is configured to actuate the commutation device within a test operation phase in such a way that energy is applied to the first electrode and the second electrode asymmetrically, wherein the control device is furthermore configured to determine the first measured value firstly during the asymmetric application of energy to the first electrode and secondly during the asymmetric application of energy to the second electrode, wherein, on the respective determination of the first measured value, the respective electrode operates as anode; wherein the control device is configured to actuate the commutation device depending on at least the determined first measured values;

the method comprising:

s1) determining at least one second measured value, which is correlated with the current through the at least one discharge lamp at least during the test operation phase;

s2) coupling the at least one second measured value to the control device; and s3) actuating the commutation device by means of the control device at least depending on the determined first measured values and second measured values.

* * * * *